United States Patent [19]

Shimazaki

[11] Patent Number: 4,857,939

[45] Date of Patent: Aug. 15, 1989

[54] MOBILE COMMUNICATIONS ANTENNA

[75] Inventor: Tetsuo Shimazaki, Tokyo, Japan

[73] Assignee: Alliance Research Corporation, Chatsworth, Calif.

[21] Appl. No.: 202,123

[22] Filed: Jun. 3, 1988

[51] Int. Cl.[4] ..... H01Q 1/32

[52] U.S. Cl. ..... 343/715; 343/713; 343/749

[58] Field of Search ..... 343/713, 714, 715, 712, 343/745, 749, 831, 875, 778

[56] References Cited

U.S. PATENT DOCUMENTS

| | | | |
|---|---|---|---|
| 4,238,799 | 12/1980 | Parfitt | 343/715 |
| 4,658,259 | 4/1987 | Blaese | 343/713 |
| 4,674,773 | 8/1987 | Larsen et al. | 343/713 |
| 4,675,687 | 6/1987 | Elliott | 343/715 |
| 4,725,846 | 2/1988 | Hendershot | 343/715 |
| 4,794,319 | 12/1988 | Shimazaki | 343/715 |

FOREIGN PATENT DOCUMENTS

| | | | |
|---|---|---|---|
| 0137391 | 4/1985 | European Pat. Off. | 343/715 |

OTHER PUBLICATIONS

Cellular Technology Dealer Catalog by ORA Electronics, 1989.

*Primary Examiner*—Rolf Hille
*Assistant Examiner*—Doris J. Johnson
*Attorney, Agent, or Firm*—Marvin H. Kleinberg; Matthew F. Jodziewicz

[57] ABSTRACT

A mobile communications antenna assembly for use over a selected band of frequencies in the VHF an UHF ranges, has, a radiating element with first, second and third, collinear radiating sections. The first and second sections each have an electrical length substantially equal to five-eights wavelength over the selected band, while the third section has an electrical length substantially equal to one-quarter wavelength. Phase inductor elements connect the sections for maintaining a predetermined phase relationship between electrical signals radiating from the sections. The third section further has a radiating surface area that is substantially greater than the radiating surface areas of the first and second sections. The base end of the third section is mounted to be elevated above the surface. The transmission line is connected to impedance matching means at a point where impedance of the two is substantially equal.

39 Claims, 3 Drawing Sheets

MOBILE COMMUNICATIONS ANTENNA

BACKGROUND OF THE INVENTION

1. Field of the Invention

This invention relates in general to communications antennas, and, more particularly, to a mobile communications antenna for use over a selected band of frequencies in the VHF and UHF frequency bands.

2. Description of the Related Art

It has long been known that an antenna can be mounted on a pane of glass and that the dielectric properties of the glass can be advantageously used to capacitively couple the antenna to radio apparatus when they are on opposite sides of the glass.

The first teachings of mounting such an antenna on a non-conductive surface of a vehicle can be found in such patents as U.S. Pat. No. 1,715,952 to J. A. Rostron. Rostron taught a window mounted antenna that was capacitively coupled, through the window, to a transmitting or receiving apparatus.

With the popularity of radios in automobiles, several early inventors patented antennas which were mounted on vehicular windows or windshields. While most of these early references were directed towards antennas suitable for receiving signals, it was the recent popularity of first the Citizen's Band radios and, more recently, the cellular telephone, as a car accessory, that caused the prior art to expand in the area of mobile communications antennas suitable for mounting on non-conductive areas of a vehicle that could both transmit as well as receive signals.

The cellular telephone system generally employs for each subscriber to the system, a transceiver operating in the VHF or UHF frequency bands, e.g., for the UHF bands approximately 820 to 895 MHz.

At these frequencies, one wavelength can be approximately one foot, thereby allowing great latitude in the design of the antenna system.

Until recently, however, there have been generally only two basic designs of mobile communications antennas for mounting on a non-conductive surface of a vehicle being used.

The most popular of these two designs is a two element antenna having its radiating elements essentially collinear and separated by an open air helical inductor coil. This prior art design yields about 3 dB gain for the signal.

The second major design in current use has two radiating elements with an electrical length equal to substantially one-quarter wavelength and electrically connected into a vertical dipole configuration.

Since any antenna system that involved transmission of its signal through a non-conducting surface involves loss of signal strength and an increase in the standing wave ratio on the tranmission line, a design was sought that would yield a higher signal gain over existing designs, while still minimizing both the signal loss and the standing wave ratio on the transmission line.

The present invention meets these requirements for a higher signal gain over existing designs while still minimizing both the signal loss due to the transmission of the signal through the non-conductive mounting surface and lessening the standing wave ratio, generally found for such designs, on the transmission line.

SUMMARY OF THE INVENTION

Due to the high frequencies and consequently short wavelengths of the band allotted the cellular telephone system, the present invention can be used as a cellular telephone communications antenna in an antenna assembly having a vertical radiating element that would have made the invention impractical for use at lower frequencies. This is because lower operating frequencies would have required a total mast length of the vertical radiating element to be so great as to be impractical to withstand the wind loading and other stressing forces exerted upon a glass-mounted vehical antenna.

The design of the present invention presents an antenna assembly having generally an omni-directional radiation pattern and a gain of about 4.2 dB (under ideal conditions), but, taking into account losses encountered due to the impedance of the glass through which the signal passes when the assembly is mounted on a vehicle's window, the transmission line loss, and standing waves caused by improper installation, the practical gain of the assembly is in the order of 3.5 dB.

For comparison, current prior art antennas similarly mounted on a vehicle have a practical gain of about 2.0 to 2.2 dB based upon actual measurements.

One of the inherent problems of multi-sectional, radiating vertical array antennas, is the narrow bandwidth, and low Q-factor, of the assembly. Since the bandwidth of the cellular telephone band over which the present invention would find its greatest use is about 40 MHz, a method of increasing the bandwidth of the antenna had to be devised.

Accordingly, to increase the bandwidth of an antenna embodying the invention, the radiating surface area of the lower radiating section of the antenna array was increased. This improvement is noticeable at high frequencies such as VHF and UHF frequencies, where the radiating current tends to flow on the surface of the radiating element. Increasing the radiating surface area of the lower radiating section also improves the Q-factor of the antenna assembly and increases the bandwidth of the overall radiating assembly. By proper selection of the radiating surface are of the lower radiating section, the bandwidth of the entire assembly can be extended to accommodate the entire 40 MHz of the cellular telephone band while still maintaining a fairly short overall length for the radiating element of the antenna assembly.

Another advantage of the present invention is that an antenna embodying the present invention would preferably use a power feed connection to the transmission line, that is, a combination of both current and voltage. As such, it becomes necessary that at least a portion of the radiating element of the antenna assembly rises above its surroundings to provide an unobstructed radiation path for the radiated electrical signal. In a vehicle mounting situation, this would require that a portion of the radiating element rise above the vehicle's highest body portion, which is normally the roof.

The feed point of an antenna assembly embodying the present invention would also preferably be elevated above the vehicle's body upon which it is mounted so that most of the energy of the antenna will be radiated above the vehicle's roofline.

In summary then, a preferred embodiment of the present invention in a mobile communications antenna assembly for use over a selected band of frequencies in the VHF and UHF ranges, would include a radiating element having first, second and third, collinear radiating sections. The first and second collinear radiating sections each have an electrical length substantially equal to five-eighths wavelength, while the third radiating section has an electrical length substantially equal to one-quarter wavelength. Each section is electrically connected to its adjacent section by phase inductor elements for maintaining a predetermined phase relationship between electrical signals radiating from the sections. The third collinear radiating section further has a radiating surface area that is substantially greater than the radiating surface areas of the first and second radiating sections. A base member is electrically connected to and disposed adjacent a base end of the third radiating section of the radiating element for mounting the radiating element to a surface, so that the base end of the third radiating section is elevated above the surface. Impedance matching circuitry selectively tunable to the nominal resonant frequency of the radiating element is electrically connected thereto. A connector is provided for connecting a transmission line to the impedance matching circuitry at a point where the impedance of the impedance matching circuitry is substantially equal to the impedance of the transmission line.

The novel features of construction and operation of the invention will be more clearly apparent during the course of the following description, reference being had to the accompanying drawings wherein has been illustrated a preferred form of the device of the invention and wherein like characters of reference designate like parts throughout the drawings.

DESCRIPTION OF THE PREFERRED EMBODIMENTS

Figure 1:
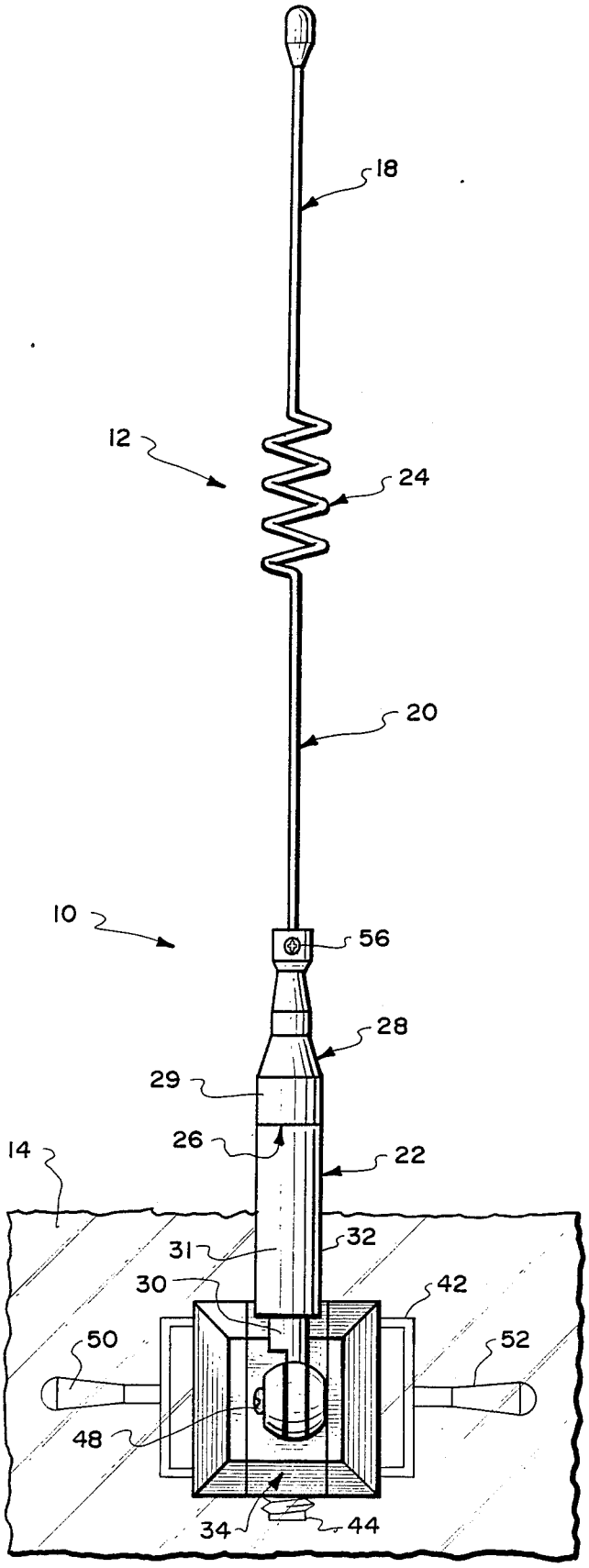
FIG. 1 is a front view of a preferred embodiment of a glass mounted antenna for use on vehicles embodying the present invention.
Figure 2:
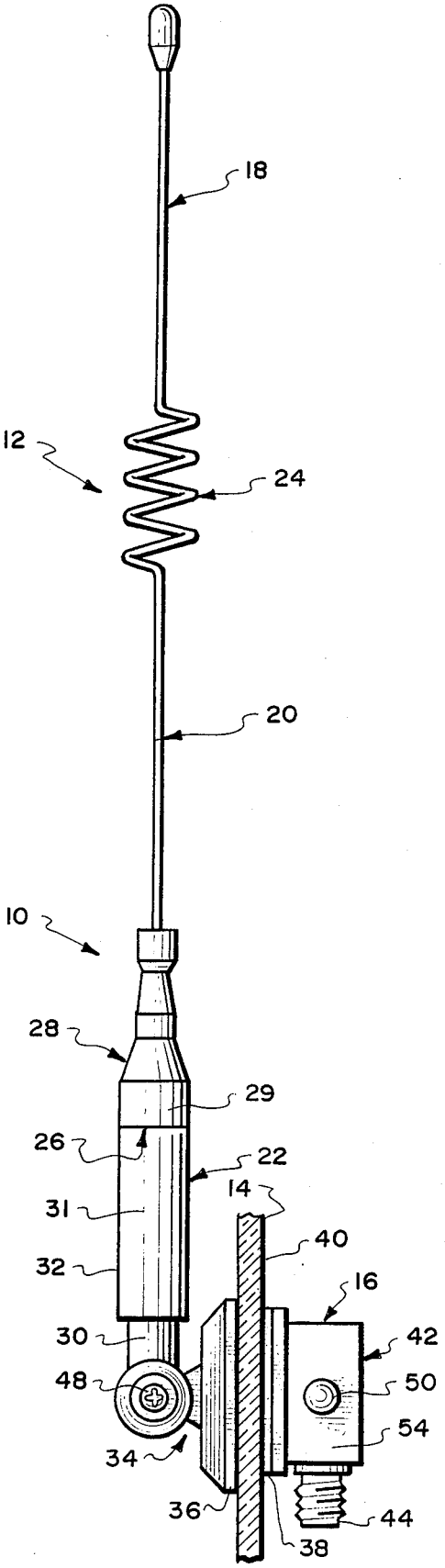
FIG. 2 is a side view of the antenna assembly of FIG. 1.

Turning first to FIGS. 1 and 2, there is shown a glass mounted antenna assembly 10 that is constructed in accordance with the present invention and useful as a mobile communications antenna assembly capable of being mounted on a vehicle and adapted for use over a selected band of frequencies in the VHF and UHF ranges.

In assembly 10 a primary antenna radiating element 12 is mounted on the exterior of a glass 14 and coupling and tuning circuit elements 16 are mounted on the interior surface of the glass 14. It is understood that although the invention is shown as being mounted on opposite sides of a glass pane, the antenna would function equally well if the material separating the elements were any other dielectric such as a plastic panel. Likewise, as will be described below and shown in FIGS. 5 and 6, the invention can be embodied in an antenna assembly that is capable of being mounted on a single side of a mounting surface that is either non-conductive or, with minor modification, conductive so as to provide a ground plane for the radiating elements of the antenna system.

In this first preferred embodiment, it is seen that the invention is ideally suited for use with motor vehicles and can be used on the windshield, the back window, any glass or plastic panel, or any location that provides optimum operation. In this first preferred embodiment, only the primary radiating element 12 is on the exterior of the vehicle. The remaining elements of assembly 10 are in the interior of the vehicle, where they can be directly connected to a transceiver through conventional transmission line means such as coaxial cable.

As seen in FIG. 1, the primary radiating element 12 contains first, second and third, collinear radiating sections, 18, 20 and 22, respectively.

First and second collinear radiating sections 18 and 20, each have an electrical length substantially equal to five-eighths of the center wavelength of the selected frequency band. Sections 18 and 20 are separated and electrically connected to one another by a first phasing inductance coil 24. Coil 24 is adapted to maintain a predetermined phase relationship between electrical signals radiating from the first and second sections 18, 20, and is preferably a helical open air coil formed from the primary radiating element 12 itself.

First and second collinear radiating sections 18 and 20 may also have differing electrical lengths, such as both, or even one of the radiating sections being substantially equal to one-half of the center wavelength of the selected frequency band. These radiating sections may, with appropriate modification of the first phasing coil 24 to maintain the desired predetermined phase relationship between electrical signals radiating from the two sections, take on any electrical length between one-half to five-eighths of the center wavelength of the selected frequency band.

The third collinear radiating section 22 has an electrical length substantially equal to one-quarter of the center wavelength of the selected frequency band and is electrically connected at one end 26 to second collinear radiating section 20 by a second phasing inductance coil 28. Coil 28 is also adapted to maintain a predetermined phase relationship between electrical signals radiating from the second and third sections, 20 and 22 respectively. Coil 28 is also preferably protected by mounting and covering it with a portion 29 of the second radiating section 20. In this latter construction, third section 22 can be covered with a layer 31 of insulating material so as to prevent shorting of the electrical signal between the second and third sections, thus providing for both a safer and more aesthetically pleasing final product capable of withstanding both environmental forces and mechanical stresses of vehicle movement.

Third section 22 has a second opposite base end 30 that is adapted to mate with a mounting assembly better described below.

Third collinear radiating section 22 further has a radiating surface 32 with an area that is substantially greater than the radiating surface areas of each of the first and second radiating sections 18 and 20.

As shown in the FIGS., one preferred way of providing third collinear radiating section with an enlarged radiating surface 32, is to construct section 22 with a diameter substantially greater than the diameter of each of the first and second radiating sections 18 and 20. In this manner the radiating surface area 32 of third collinear radiating section 22 will be greater in comparison to the radiating surface areas of the first and second sections.

A base assembly 34, is connected to the base end 30 of the third radiating section 22 to provide a mounting support for the radiating element 12. Base 34 preferably is user adjustable to permit radiating element 12 to be maintained generally vertical to the surface over which the vehicle is travelling. This user adjustment may be accomplished by having a the radiating element pivotally connected to base 34 and held in desired position by a set screw 48.

To permit some versatility and limited tuning adjustment by the user within the designed frequency band of the antenna assembly, the primary radiating element 12 can move, at base end 30 of its third radiating section, with respect to its connection to base assembly 34 by means of a set screw 56 that can be used to vary the exposed length of the radiating element 12 and to lock it at the optimum length.

Base 34 has an electrically conductive plate member 36 attached thereto having a fixed surface area. Member 36 is electrically connected to and disposed adjacent base end 30 of third radiating section 22, for mounting radiating element 12 to a first, exterior side 14 of a non-conductive body portion, here shown to be the exterior portion 14 of a glass window of a vehicle.

In this manner, the base end 30 of third radiating section 22 is elevated above the surface of the glass window and, accordingly, of the surrounding body portion of the vehicle itself.

A second electrically conductive coupling member 38 is mounted on a second, opposite side 40 of the non-conductive body portion (glass window) in substantial juxtaposition with first electrically conductive member 36 and defines with non-conductive body portion (glass window) intermediate these two members 36 and 38, a coupling capacitor having a fixed plate surface area at the base end 30 of the third radiating section and located adjacent a current node thereof.

Impedance matching circuitry 42, which may include a tuned circuit, such as a series tuned circuit, that is selectively tunable to the nominal resonant frequency of the radiating element, is electrically connected to second electrically conductive coupling member 38 in the immediate proximity thereof to resonate in conjunction with radiating element 12. Impedance matching circuitry 42 preferably has an impedance which varies between a first impedance, measured at the connection to the second electrically conductive coupling member 38, substantially equal to the impedance at the base end 30 of third radiating section 22, and a second impedance at least several orders of magnitude less than the first impedance.

In a preferred embodiment of the invention, impedance matching circuitry 42 would include a user adjustable capacitance member (as shown in FIGS. 3 through 6), so that minor adjustments can be made in the field to accommodate the antenna assembly to changes in its operating environment. Such changes can be occasioned by different thicknesses in the glass window through which the signal is transmitted or by a change in capacitance or impedance caused by a build up of pollutants on the antenna assembly itself.

A coaxial fitting 44 connects a transmission line (not shown) to impedance matching circuitry 42 at a point where the impedance is substantially equal to the impedance of the transmission line.

The transmission line is preferably a coaxial cable that connects antenna assembly 10 and a radio communications unit (not shown). The transmission line should have an impedance that is orders of magnitude less than the impedance of the antenna assembly 10 at base end 30 of the third radiating section thereof.

Extending at right angles to a line parallel to the axis of the primary radiating element 12, are first and second stub antennas 50 and 52 respectively. Each preferably has an effective wavelength of one-quarter of a wavelength. The stub antennas 50, 52, are mounted on an interior base member 54 which is adapted to be adhered to the inner surface 40 of the glass window.

The interior and exterior mounted coupling members 36 and 38, are designed to be matched in alignment when mounted since each is intended to be one plate of a capacitor which uses the glass window itself as the dielectric element.

Figure 3:
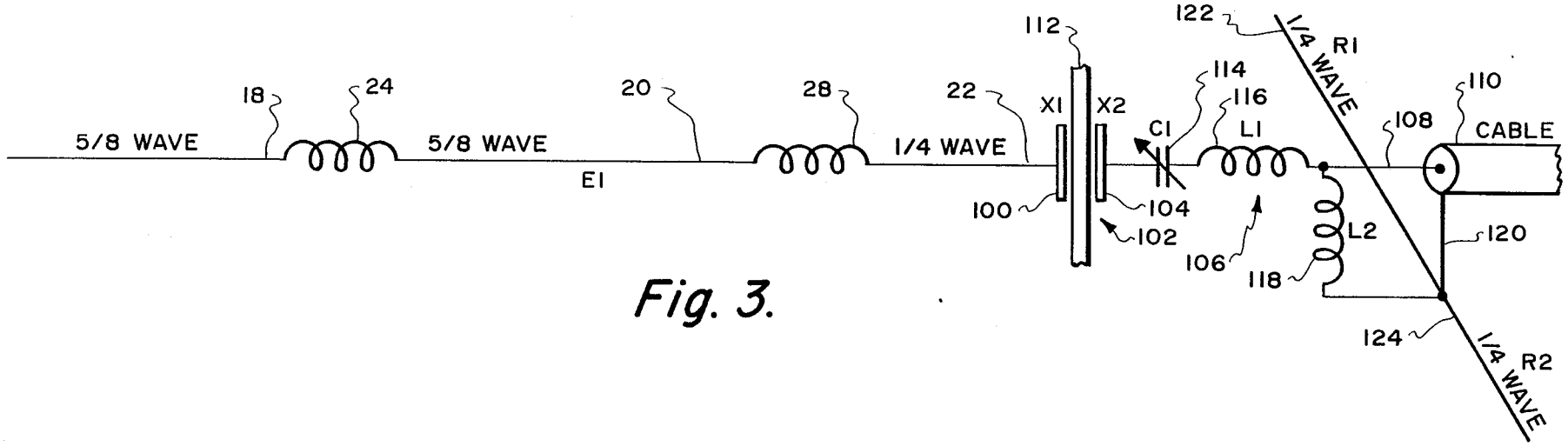
FIG. 3 is an idealized schematic diagram of the circuit of the antenna assembly of FIG. 1.

Turning next to FIG. 3, there is shown a preferred circuit for use with the antenna of the present invention. As shown, the primary antenna radiating element 12 is shown directly connected to one plate 100 of a capacitor 102, the other plate 104 of which is connected through a tuning circuit 106 to the signal lead 108 of a coaxial cable 110 that is coupled to a transceiver (not shown). The glass 112 to which the capacitor plates 100, 104 are adhered, is the dielectric for the capacitor 102. An adjustable tuning capacitor 114 is serially connected to the "inside" plate 104, and may, for circuit purposes, be considered a "lumped" capacitive element.

In the preferred embodiment, a first inductor 116 serially couples the capacitors 102, 114 to the signal lead 108. A second inductor 118 couples the signal lead 108 to the ground or shield 120 of the coaxial cable 110. The stub antennas 122, 124 are connected to the grounded shield 120, as well.

In use, the circuit is connected to a transceiver and a standing wave ratio meter is used in conjunction with the adjustable tuning capacitor 114 to achieve peak performance in the 820 to 895 MHz frequency band which has been alloted to cellular mobile telephone system use. The total capacitance (of the dielectric panel and the adjustable tuning capacitor 114) functions to "cancel" the inductive reactance of the antenna.

The inductors 116, 118 are selected to match the impedance of the antenna circuit to the coaxial cable 110. Accordingly, energy can be transferred through the glass or other dielectric panel with a minimum of energy loss.

Because the antenna circuit is designed to operate in the power (current and voltage) feed mode, the grounded stub antennas 122, 124 act as a "mirror image" (ground plane) of the primary antenna radiating element 12. In the absence of the grounded stub antennas, a reflection current would appear at the coaxial cable 110 and a good impedance match would be difficult, if not impossible to achieve.

Figure 4:
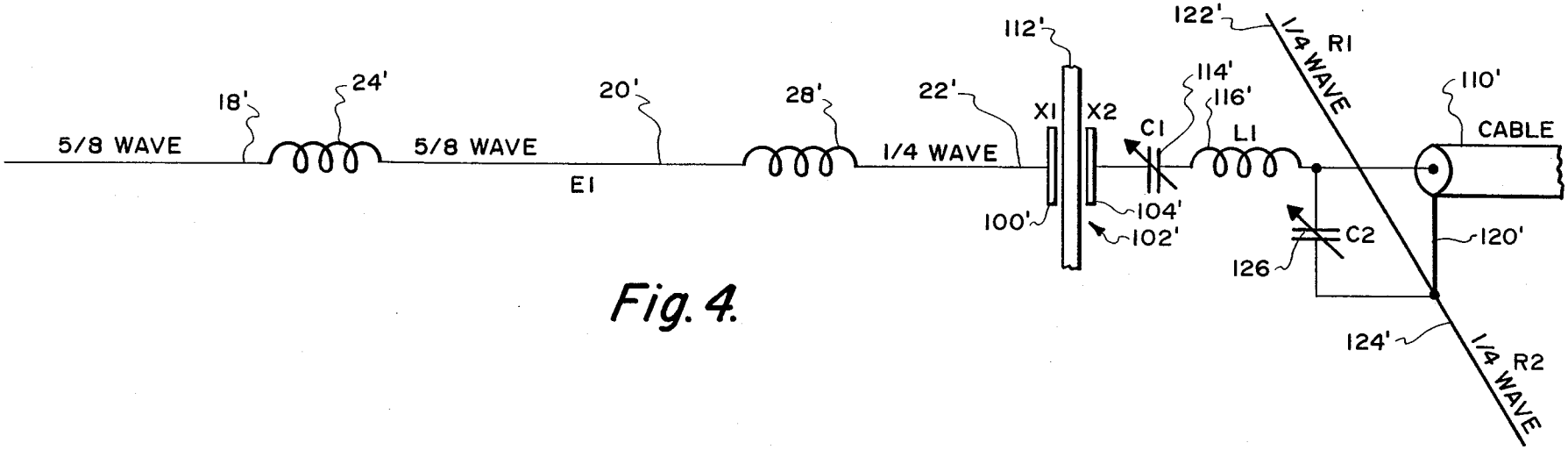
FIG. 4 is an idealized schematic diagram of an alternative circuit for the antenna assembly of FIG. 1.

FIG. 4 is an alternative circuit embodiment in which a second trimmer capacitor 126 is substituted for the second inductor 118 of FIG. 3. Other elements in FIG. 4, similar to those elements described above for FIG. 3, are shown as primed reference numerals corresponding to their unprimed counterparts in FIG. 3. With the circuit shown in FIG. 4, the optimum frequency range for which it is tuned tends to be quite sharp and narrow. Accordingly, it is not as satisfactory when dealing with a relatively broad frequency band such as the approximately 75 MHz bandwidth available in the cellular telephone band. However, for those applications where the frequencies in use fall within a fairly narrow band, the alternative embodiment should prove satisfactory.

Figure 5:
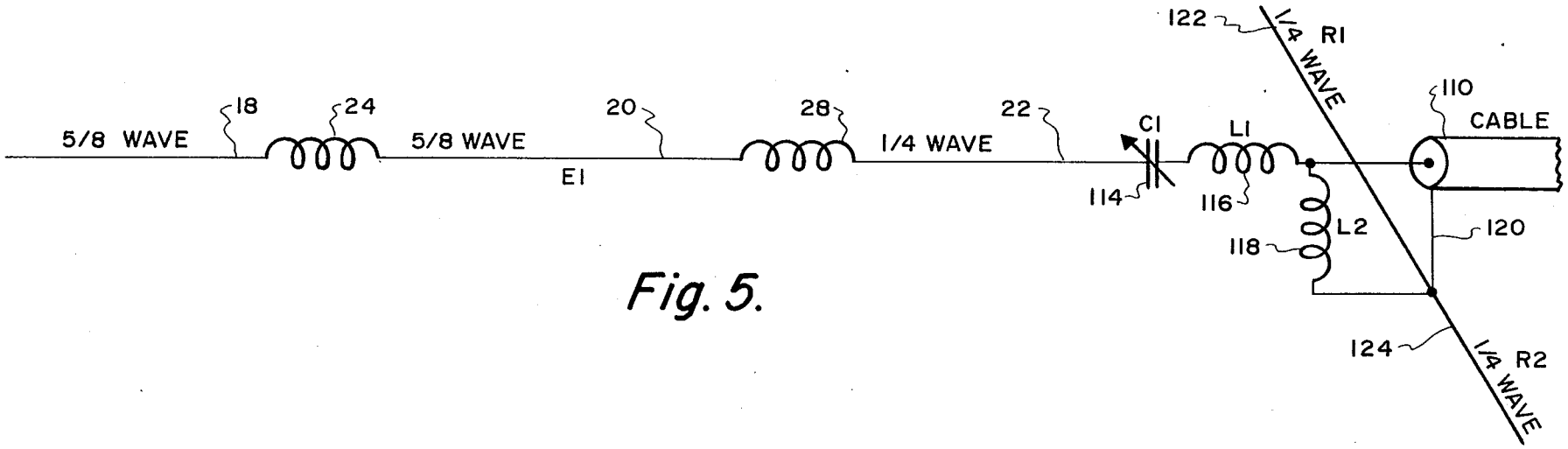
FIG. 5 is an idealized schematic diagram of a circuit for the antenna assembly of the present invention similar to that of FIG. 3 wherein the assembly does not pass its signal through an intervening glass medium; and, FIG. 6 is an idealized schematic diagram of a circuit for the antenna assembly of the present invention similar to that of FIG. 4 wherein the assembly does not pass its signal through an intervening glass medium.
Figure 6:
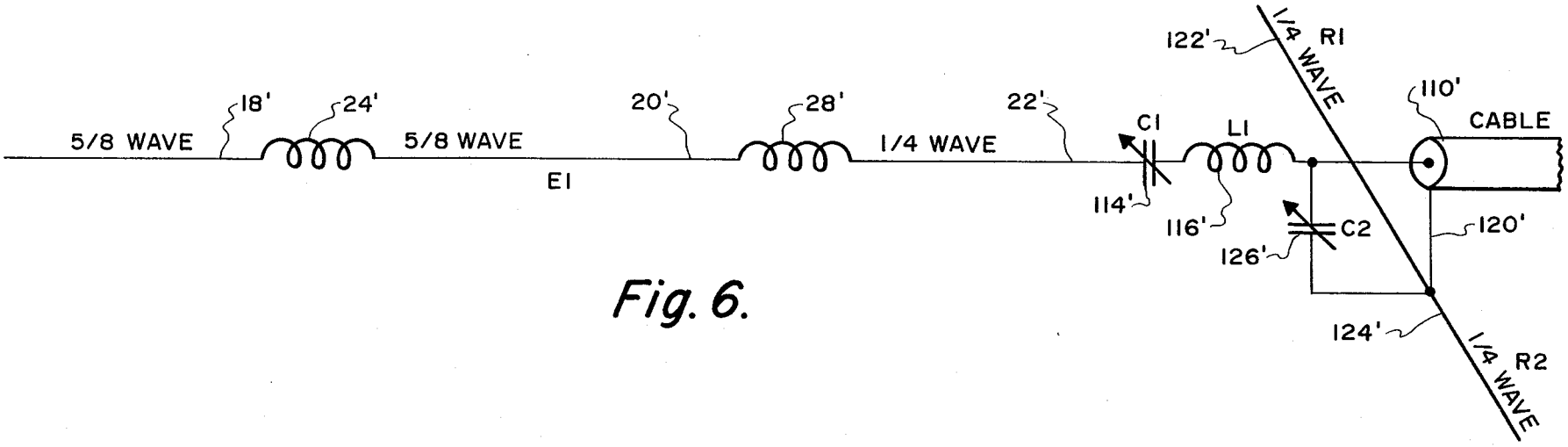

Turning next to FIGS. 5 and 6, there is shown in schematic form an alternative antenna system embodying the present invention generally employing stub antennas mounted on a single side of a non-conductive body portion of a vehicle along with the principal antenna element. In this embodiment, only a single base element is employed which can be fastened to virtually any surface and does not require an exterior and an interior mounted antenna assembly.

In general, FIGS. 5 and 6 are similar to FIGS. 3 and 4, respectively, and illustrate the general electrical connections of an antenna assembly embodying the present invention adapted for mounting to a single side of a non-conductive body portion of a vehicle. Similar parts retain the same reference numerals, the only difference being the absence of the capacitors 102, 102'.

Finally, it should be noted that if the antenna of the present invention is to be mounted on a body portion of a vehicle that is suitable as a reflective signal ground plane, then the stub antennas described above may be eliminated and the principal radiating element described above may be directly mounted to the desired location by any number of presently known mounting brackets.

The invention described above is, of course, susceptible to many variations, modifications and changes, all of which are within the skill of the art. It should be understood that all such variations, modifications and changes are within the spirit and scope of the invention and of the appended claims. Similarly, it will be understood that it is intended to cover all changes, modifications and variations of the example of the invention herein disclosed for the purpose of illustration which do not constitute departures from the spirit and scope of the invention.

What is claimed is:

1. A mobile communication antenna assembly for use over a selected band of frequencies in the VHF and UHF ranges, comprising:

a radiating element having first, second and third, collinear radiating sections, said first and second sections each having an effective electrical length substantially equal to five-eighths of the center wavelength of the selected frequency band and said third section having an effective electrical length substantially equal to one-quarter of the center wavelength of the selected frequency band, said third section further adapted to have a radiating surface area substantially greater than the radiating surface areas of said first and second sections by having a diameter substantially greater than the diameter of each of said first and second sections, so as to increase the radiating surface area of said third section in comparison to the radiating surface areas of said first and second sections;

first phase inductance means electrically connecting said first and second sections for maintaining a predetermined phase relationship between electrical signals radiating from said first and second sections including an open air helical coil inductor formed from said radiating element;

second phase inductance means electrically connecting said second and third sections for maintaining a predetermined phase relationship between electrical signals radiating from said second and third sections including a helical coil inductor formed from said radiating element;

a base member electrically connected adjacent to a base end of said third section for mounting said radiating element to a non-conducting surface of a vehicle, so that said third section base end is elevated above said surface;

a first plate member connected to said third section base end including user adjustment means for positioning said radiating element in a generally vertical configuration with regard to the earth's surface;

impedance matching means comprising a user adjustable capacitance member and a series series tuned circuit which is selectively tunable to the nominal resonant frequency of said radiating element and electrically connected thereto, said impedance matching means displaying an impedance which varies between a first impedance value at said connection to said radiating element, said first value being substantially equal to the impedance at said base end, and a second impedance value that is at least several orders of magnitude less than said first impedance value;

transmission line means for communicating between the antenna assembly and a radio communications unit, said transmission line means having an impedance that is orders of magnitude less than the impedance of the antenna assembly at said base end of said third section; and connecting means for coupling said transmission line means to said impedance matching means at a point where the impedance of said impedance matching means is substantially equal to the impedance of the transmission line means.

2. A mobile communications antenna assembly for use over a selected band of frequencies in the VHF and UHF ranges, comprising:

a radiating element having first, second and third, collinear radiating sections, said first and second sections each having an effective electrical length substantially equal to five-eighths of the center wavelength of the selected frequency band and said third section having an effective electrical length substantially equal to one-quarter of the center wavelength of the selected frequency band;

first phase inductance means electrically connecting said first and second sections for maintaining a predetermined phase relationship between electrical signals radiating from said first and second sections;

second phase inductance means electrically connecting said second and third sections for maintaining a predetermined phase relationship between electrical signals radiating from said second and third sections;

a base member electrically connected adjacent to a base end of said third section for mounting said radiating element to a surface so that said third section base end is elevated above said surface;

impedance matching means comprising a tuned circuit selectively tunable to the nominal resonant frequency of said radiating element and electrically connected thereto, said impedance matching means displaying an impedance which varies between a first impedance value at said connection to said radiating element, said first value being substantially equal to the impedance at said base end, and a second impedance value that is at least several orders of magnitude less than said first impedance value; and connecting means for coupling transmission line means to said impedance matching means at a point where the impedance of said impedance matching means is substantially equal to the impedance of the transmission line means.

3. A mobile communications antenna assembly in accordance with claim 2 wherein said third section further has a radiating surface area that is substantially greater than the radiating surface areas of said first and second sections.

4. A mobile communications antenna assembly in accordance with claim 2 wherein said impedance matching means includes a user adjustable capacitance member.

5. A mobile communications antenna assembly in accordance with claim 2, further including transmission line means coupled to said connection means for communicating between the antenna assembly and a radio communications unit, said transmission line means having an impedance that is orders of magnitude less than the impedance of the antenna assembly at said base end of said third section.

6. A mobile communications antenna assembly in accordance with claim 2, wherein said impedance matching means comprises a series tuned circuit tuned to the nominal resonant frequency of said radiating element of the antenna assembly.

7. A mobile communications antenna assembly in accordance with claim 2, including a first plate member connected to said third section base end including user adjustment means for positioning said radiating element in a generally vertical configuration with regard to the earth's surface.

8. A mobile communications antenna assembly in accordance with claim 2, wherein said first phase inductance means comprises a helical coil inductor formed from said radiating element.

9. A mobile communications antenna assembly in accordance with claim 8, wherein said helical coil inductor is an open air helical coil inductor.

10. A mobile communications antenna assembly in accordance with claim 2, wherein the surface to which said base member is mounted is a non-conductive body portion of a vehicle.

11. A mobile communications antenna assembly in accordance with claim 10, wherein said non-conductive body portion is a glass window.

12. A mobile communications antenna assembly in accordance with claim 2, wherein said non-conductive body portion of said vehicle is a fiber-glass panel.

13. A mobile communications antenna assembly in accordance with claim 2, wherein said third section has a diameter substantially greater than the diameter of each of said first and second sections, so as to increase the radiating surface area of said third section in comparison to the radiating surface areas of said first and second sections.

14. A mobile communications antenna assembly adapted for mounting on a vehicle and adapted for use over a selected band of frequencies in the VHF and UHF ranges, comprising:

a radiating element having first, second and third, collinear radiating sections, said first and second sections each having an electrical length substantially equal to five-eighths of the center wavelength of the selected frequency band, and said third section having an electrical length substantially equal to one-quarter of the center wavelength of the selected frequency band, said third section further adapted to have a radiating surface area substantially greater than the radiating surface areas of said first and second sections by having a diameter substantially greater than the diameter of each of said first and second sections, so as to increase the radiating surface area of said third section in comparison to the radiating surface areas of said first and second sections;

first phase inductance means connecting said first and second sections for maintaining a predetermined phase relationship between electrical signals radiating from said first and second sections including an open air helical coil inductor formed from said radiating element;

second phase inductance means connecting said second and third sections for maintaining a predetermined phase relationship between electrical signals radiating from said second and third sections, said third section having a base end;

said third section further having a radiating surface area that is substantially greater than the radiating surface areas of each of said first and second radiating sections;

a base member, having a first conductive coupling member electrically connected to and disposed adjacent said third section base end, for mounting said radiating element to a first side of a non-conductive body portion of the vehicle so that said third section base end is elevated above the surface of said body portion and including a first adjusting means connected between said third section base end and said first coupling member to permit user adjustment to align said radiating element to be generally vertical with regard to the earth's surface;

a second conductive coupling member mounted on a second, opposite side of said non-conductive body portion in substantial juxtaposition with said first conductive coupling member defining, with said non-conductive body portion, a coupling capacitor having a fixed plate surface area at the third section base end and located adjacent a current node thereof;

impedance matching means comprising a user adjustable capacitance member and a series tuned circuit selectively tunable to the nominal resonant frequency of said radiating element and electrically connected to said second electrically conductive coupling member in the immediate proximity thereof to resonate in conjunction with said radiating element, said impedance matching means displaying an impedance which varies between a first impedance value at said connection to said second conductive coupling member which is substantially equal to the impedance at said third section base end and a second impedance value that is at least several orders of magnitude less than said first impedance value;

transmission line means for connection between the antenna assembly and a radio communications unit, said transmission line means having an impedance that is orders of magnitude less than the impedance of the antenna assembly at said third section base end; and coupling means adapted to connect said transmission line means to said impedance matching means at a point where the impedance of said impedance matching means is substantially equal to the impedance of said transmission line means.

15. A mobile communications antenna assembly in accordance with claim 14, wherein said non-conductive body portion is a glass window.

16. A mobile communications antenna assembly in accordance with claim 14, wherein said wherein said non-conductive body portion of the vehicle is a fiberglass panel.

17. A mobile communications antenna assembly adapted for mounting on a vehicle and adapted for use over a selected band of frequencies in the VHF and UHF ranges, comprising:

a radiating element having first, second and third, collinear radiating sections, said first and second sections each having an electrical length substantially equal to five-eighths of the center wavelength of the selected frequency band and said third section having an electrical length substantially equal to one-quarter of the center wavelength of the selected frequency band;

first phase inductance means connecting said first and second sections for maintaining a predetermined phase relationship between electrical signals radiating from said first and second sections;

second phase inductance means connecting said second and third sections for maintaining a predetermined phase relationship between electrical signals radiating from said second and third sections, said third section having a base end;

said third section further having a radiating surface area that is substantially greater than the radiating surface areas of each of said first and second radiating sections;

a base member, having a first conductive coupling member electrically connected to and disposed adjacent said third section base end, for mounting said radiating element to a first side of a non-conductive body portion of the vehicle so that said third section base end is elevated above the surface of said body portion;

a second conductive coupling member mounted on a second, opposite side of said non-conductive body portion in substantial juxtaposition with said first conductive coupling member defining, with said non-conductive body portion, a coupling capacitor having a fixed plate surface area at the third section base end and located adjacent a current node thereof;

impedance matching means comprising a tuned circuit selectively tunable to the nominal resonant frequency of said radiating element and electrically connected to said second electrically conductive coupling member in the immediate proximity thereof to resonate in conjunction with said radiating element, said impedance matching means displaying an impedance which varies between a first impedance value at said connection to said second conductive coupling member which is substantially equal to the impedance at said third section base end and a second impedance value that is at least several orders of magnitude less than said first impedance value; and coupling means adapted to connect transmission line means to said impedance matching means at a point where the impedance of said impedance matching means is substantially equal to the impedance of the transmission line means.

18. A mobile communications antenna assembly in accordance with claim 17 wherein said third section further has a radiating surface area that is substantially greater than the radiating surface areas of said first and second sections.

19. A mobile communications antenna assembly in accordance with claim 17, wherein said impedance matching means includes a user adjustable capacitance member.

20. A mobile communications antenna assembly in accordance with claim 17, further including transmission line means for connection between the antenna assembly and a radio communications unit, said transmission line means having an impedance that is orders of magnitude less than the impedance of the antenna assembly at said third section base end.

21. A mobile communications antenna assembly in accordance with claim 17, wherein said impedance matching means comprises a series tuned circuit that is tuned to the nominal resonant frequency of said radiating element of the antenna assembly.

22. A mobile communications antenna assembly in accordance with claim 17, including a first adjusting means connected between said third section base end and said first coupling member to permit user adjustment to align said radiating element to be generally vertical with regard to the earth's surface.

23. A mobile communications antenna assembly in accordance with claim 17, wherein said first and second inductance means each comprises a helical coil inductor formed from said radiating element.

24. A mobile communications antenna assembly in accordance with claim 23, wherein each said helical coil inductor is an open air helical coil inductor.

25. A mobile communications antenna assembly in accordance with claim 17, wherein said non-conductive body portion is a glass window.

26. A mobile communications antenna assembly in accordance with claim 17, wherein said wherein said non-conductive body portion of the vehicle is a fiberglass panel.

27. A mobile communications antenna assembly in accordance with claim 17, wherein said third section has a diameter substantially greater than the diameter of each of said first and second sections, so as to increase the radiating surface area of said third section in comparison to the radiating surface areas of said first and second sections.

28. A mobile communications antenna assembly for use over a selected band of frequencies in the VHF and UHF ranges, comprising:

a radiating element having first, second and third, collinear radiating sections, said first and second sections each having an effective electrical length substantially equal to at least one-half of the center wavelength of the selected frequency band and said third section having an effective electrical length substantially equal to one-quarter of the center wavelength of the selected frequency band, said third section further adapted to have a radiating surface area substantially greater than the radiating surface areas of said first and second sections by having a diameter substantially greater than the diameter of each of said first and second sections, so as to increase the radiating surface area of said third section in comparison to the radiating surface areas of said first and second sections;

first phase inductance means electrically connecting said first and second sections for maintaining a predetermined phase relationship between electrical signals radiating from said first and second sections including an open air helical coil inductor formed from said radiating element;

second phase inductance means electrically connecting said second and third sections for maintaining a predetermined phase relationship between electrical signals radiating from said second and third sections including a helical coil inductor formed from said radiating element;

a base member electrically connected adjacent to a base end of said third section for mounting said radiating element to a non-conducting surface of a vehicle, so that said third second base end is elevated above said surface;

a first plate member connected to said third section base end including user adjustment means for positioning said radiating element in a generally vertical configuration with regard to the earth's surface;

impedance matching means comprising a user adjustable capacitance member and a series series tuned circuit which is selectively tunable to the nominal resonant frequency of said radiating element and electrically connected thereto, said impedance matching means displaying an impedance which varies between a first impedance value at said connection to said radiating element, said first value being substantially equal to the impedance at said base end, and a second impedance value that is at least several orders of magnitude less than said first impedance value;

transmission line means for communicating between the antenna assembly and a radio communications unit, said transmission line means having an impedance that is orders of magnitude less than the impedance of the antenna assembly at said base end of said third section; and connecting means for coupling said transmission line means to said impedance matching means at a point where the impedance of said impedance matching means is substantially equal to the impedance of the transmission line means.

29. A mobile communications antenna assembly for use over a selected band of frequencies in the VHF and UHF ranges, comprising:

a radiating element having first, second and third, collinear radiating sections, said first and second sections each having an effective length substantially equal to one-half of the center wavelength of the selected frequency band and said third section having an effective electrical length substantially equal to one-quarter of the center wavelength of the selected frequency band;

first phase inductance means electrically connecting said first and second sections for maintaining a predetermined phase relationship between electrical signals radiating from said first and second sections;

second phase inductance means electrically connecting said second and third sections for maintaining a predetermined phase relationship between electrical signals radiating from said second and third sections;

a base member electrically connected adjacent to a base end of said third section for mounting said radiating element to a surface so that said third section base end is elevated above said surface;

impedance matching means comprising a tuned circuit selectively tunable to the nominal resonant frequency of said radiating element and electrically connected thereto, said impedance matching means displaying an impedance which varies between a first impedance value at said connected to said radiating element, said first value being substantially equal to the impedance at said base end, and a second impedance value that is at least several orders of magnitude less than said first impedance value; and connecting means for coupling transmission line means to said impedance matching means at a point where the impedance of said impedance matching means is substantially equal to the impedance of the transmission line means.

30. A mobile communications antenna assembly for use over a selected band of frequencies within the VHF and UHF ranges, comprising:

a radiating element having first, second and third collinear radiating sections, each of said sections having an effective electrical length substantially equal to at least one-quarter of the center wavelength of the selected frequency band;

first phase inductance means electrically connected to said first and second radiating sections, and second phase inductance means electrically connected to said second and third radiating sections respectively, for maintaining a predetermined phase relationship between electrical signals radiating from each of said paired radiating sections;

said second radiating section having a first portion and a second portion including a hollow, generally frusto-conically shaped radiating member attached proximate said second phase inductance means, and having an opening at its base end with sufficient diameter to receive and overlap, at least partially, a portion of said third radiating section, and electrically connected to said third radiating section only through said second phase inductance means; and, said third radiating section further adapted to have a radiating surface area substantially greater than the radiating surface areas of said first and second sections by having a diameter substantially greater than that of said first section and said second section first portion so as to increase the radiating surface area of said third section in comparison to the radiating surface areas of said first and second sections.

31. A mobile communications antenna assembly as in claim 31 above, further including, a layer of electrical insulating material interposed between said second radiating section frusto-conically shaped radiating member and said overlapped portion of said third radiating section so as to electrically isolate said second radiating section from said third radiating section and to form a seal therebetween.

32. A mobile communications antenna assembly as in claim 31 above, wherein said third radiating section is a hollow tube member having sufficient diameter to receive and retain therein said second phase inductance means.

33. A mobile communications antenna assembly as in claim 31 above, wherein said first and second phase inductance means comprise a first and second helical coil inductor, each formed from said first and second radiating elements, respectively.

34. A mobile communications antenna assembly as in claim 31 above, wherein said first and second helical coil inductors are open air helical coil inductors.

35. A mobile communications antenna assembly for use over a selected band of frequencies in the VHF and UHF ranges, comprising:

a first hollow, tubular radiating member having an effective electrical length substantially equal to at least one-quarter of the center wavelength of the selected frequency band;

a first phase inductance means for maintaining a predetermined phase relationship of electrical signals in said first radiating member electrically connected to and received, at least partially, in the interior of said first hollow, tubular radiating member;

a second radiating section fabricated from a single wire conductor and having effective electrical length substantially equal to at least one-half of the center wavelength of the selected frequency band and electrically connected collinearly to said first phase inductance means;

a cap member attached to said second radiating section proximate said first phase inductance means and adapted to overlap, at least partially, a portion of said first radiating member for sealing said first phase inductance means within the interior of said first hollow tubular radiating member;

a second phase inductance means for maintaining a predetermined phase relationship of electrical signals in said second radiating member, electrically connected collinearly to said second radiating member; and a third radiating section fabricated from a single wire conductor and having effective electrical length substantially equal to at least one-half of the center wavelength of the selected frequency band and electrically connected collinearly to said second phase inductance means.

36. A mobile communications antenna assembly as in claim 35 above, further including, a layer of electrical insulating material interposed between said cap member of said second radiating section and said overlapped portion of said first radiating section so as to electrically isolate said cap member from direct connection with said overlapped portion of said first radiating section and to form a seal therebetween.

37. A mobile communications antenna assembly as in claim 35 above, wherein said first and second phase inductance means comprise a first and second helical coil inductor each formed from said second and third radiating elements respectively.

38. A mobile communications antenna assembly as in claim 37 above, wherein said first and second helical coil inductors are open air helical coil inductors.

39. A mobile communications antenna assembly as in claim 35 above, wherein said second and third radiating sections and said second phase inductance means are fabricated from the same single wire element.

* * * * *